US005340534A

United States Patent [19]

Magee

[11] Patent Number: 5,340,534

[45] Date of Patent: Aug. 23, 1994

[54] CORROSION RESISTANT AUSTENITIC STAINLESS STEEL WITH IMPROVED GALLING RESISTANCE

[75] Inventor: John H. Magee, Reading, Pa.

[73] Assignee: CRS Holdings, Inc., Wilmington, Del.

[21] Appl. No.: 934,565

[22] Filed: Aug. 24, 1992

[51] Int. Cl.[5] ..... C22C 35/00

[52] U.S. Cl. ..... 420/35; 420/36; 420/37; 420/38; 420/39; 420/43; 420/44; 420/45; 420/46; 420/47; 420/48; 420/50; 420/51

[58] Field of Search ..... 75/124, 128; 148/31.5, 148/36, 38; 420/46, 53, 56, 57; 428/683

[56] References Cited

U.S. PATENT DOCUMENTS

| | | | |
|---|---|---|---|
| 1,986,208 | 1/1935 | Maas | 75/1 |
| 2,177,454 | 10/1939 | Frevert et al. | 75/128 |
| 3,152,934 | 10/1964 | Lula et al. | 148/136 |
| 3,925,064 | 12/1975 | Takamura et al. | 75/128 A |
| 4,039,356 | 8/1977 | Schumacher et al. | 148/31.5 |
| 4,172,716 | 10/1979 | Abo et al. | 75/124 |
| 4,184,140 | 3/1989 | Magee, Jr. | 420/56 |
| 4,486,231 | 12/1984 | Fujiwara et al. | 75/125 |
| 4,554,028 | 11/1985 | DeBold et al. | 148/38 |
| 4,609,577 | 9/1986 | Long | 428/683 |
| 4,671,929 | 6/1987 | Kajimura et al. | 420/44 |
| 4,846,904 | 7/1989 | Arai et al. | 148/325 |
| 4,888,153 | 12/1989 | Yabuki et al. | 420/57 |
| 4,933,027 | 6/1990 | Moriya et al. | 148/402 |
| 4,999,159 | 3/1991 | Uematsu et al. | 420/53 |
| 5,000,797 | 3/1991 | Honkura et al. | 148/12 E |
| 5,000,801 | 3/1991 | Honkura et al. | 148/325 |
| 5,047,096 | 9/1991 | Eriksson et al. | 148/325 |
| 5,094,812 | 3/1992 | Dulmaine et al. | 420/57 |

FOREIGN PATENT DOCUMENTS

| | | |
|---|---|---|
| 1483432 | 9/1969 | Fed. Rep. of Germany . |
| 1444807 | 5/1966 | France . |
| 2072434 | 9/1971 | France . |
| 56-158851 | 12/1981 | Japan . |
| 56-158853 | 12/1981 | Japan . |
| WO8802032 | 3/1988 | PCT Int'l Appl. . |
| 152290 | 2/1991 | Taiwan . |
| 1097004 | 12/1967 | United Kingdom . |
| 2205856 | 12/1988 | United Kingdom . |

OTHER PUBLICATIONS

"Corrosion-Resistant Steel Castings", *Metals Handbook*, Ninth Edition, vol. 3.

"Wrought Stainless Steels", *Metals Handbook*, Tenth Edition, vol. 1.

*Primary Examiner*—Donald P. Walsh

*Assistant Examiner*—John N. Greaves

*Attorney, Agent, or Firm*—Dann, Dorfman, Herrell and Skillman

[57] ABSTRACT

An austenitic, stainless steel alloy having a good combination of galling resistance and corrosion resistance is disclosed containing in weight percent about:

| | Broad | Intermediate | Preferred |
|---|---|---|---|
| C | 0.25 max. | 0.02–0.15 | 0.05–0.12 |
| Mn | 3–10 | 4–8 | 5–7 |
| Si | 2.25–5 | 2.5–4.5 | 3–4 |
| Cr | 15–23 | 16.5–21 | 17.5–19 |
| Ni | 2–12 | 4–10 | 6–9 |
| Mo | 0.5–4.0 | 0.5–2.5 | 0.75–1.5 |
| N | 0.35 max. | 0.05–0.25 | 0.10–0.20 |

and the balance of the alloy is essentially iron. This alloy also has good resistance to formation of deformation-induced martensite as indicated by the alloy's low work-hardening rate and low magnetic permeability when cold-rolled to a 50% reduction in cross-sectional area.

26 Claims, No Drawings

CORROSION RESISTANT AUSTENITIC STAINLESS STEEL WITH IMPROVED GALLING RESISTANCE

FIELD OF THE INVENTION

This invention relates to an austenitic stainless steel alloy and in particular to such an alloy, and articles made therefrom, having a better combination of galling resistance, corrosion resistance, and resistance to formation of deformation-induced martensite, than known austenitic stainless steels. The alloy according to this invention also provides a low work hardening rate compared to the known galling resistant, austenitic, stainless steels.

BACKGROUND OF THE INVENTION

It is generally known that standard types of stainless steels have limited galling resistance. In many commercial applications requiring stainless steel, lubricants cannot be used to prevent galling of the steel surface. For example, in the food processing industry contamination concerns prohibit the use of any lubricants to prevent galling. In response to these concerns, several galling resistant stainless steel alloys were developed having superior galling resistance compared to conventional austenitic stainless steels. Two specialty galling resistant stainless steels, sold under the trademarks Nittonic 60 ® and Gall-Tough ®, have high threshold galling stress values (TGS), nominally 7 ksi (48 MPa) and 15 ksi (103 MPa), respectively. U.S. Pat. No. 4,039,356, Schumacher et al., describes the galling resistant austenitic stainless steel alloy sold under the trademark Nitronic 60 ® (registered trademark of Armco, Inc., Middletown, Ohio). That alloy consists essentially of, in weight percent(%):

| | % |
|---|---|
| C | 0.001–0.25 |
| Mn | 6–16 |
| Si | 2–7 |
| Cr | 10–25 |
| Ni | 3–15 |
| Mo | 4.0 max. |
| N | 0.001–0.4 |
| Cu | 4.0 max. |
| Fe | Bal. |

U.S. Pat. No. 4,814,140, Magee, Jr., assigned to Carpenter Technology Corp., assignee of the present application, describes a galling resistant austenitic stainless steel alloy sold under the trademark Gall-Tough ® (registered trademark of Carpenter Technology Corp., Reading, Pa.). That alloy consists essentially of, in weight percent:

| | % |
|---|---|
| C | 0.25 max. |
| Mn | 2.0–7.0 |
| Si | 1.0–5.0 |
| Cr | 12–20 |
| Ni | 2.0–7.75 |
| Mo | 3.0 max. |
| N | 0.35 max. |
| Cu | 3.0 max. |
| Fe | Bal. |

The austenitic stainless steel alloys described in Schumacher, et al. and Magee, Jr. provide galling resistance that is superior to the standard types of austenitic stainless steels. The alloys disclosed and claimed in Schumacher et al. and Magee, Jr. provide general corrosion resistance comparable to AISI Type 304 stainless steel. That level of corrosion resistance is adequate for use in many chloride-containing environments. However, some applications, such as valve components in the petrochemical industry, require galling resistance that is superior to conventional austenitic stainless steels and chloride corrosion resistance, especially pitting resistance, that is at least as good as that provided by AISI Type 316 stainless steel.

Type 316, an austenitic stainless steel, has very good chloride pitting resistance, but its galling resistance is much lower than the alloys described by Schumacher, et al. and Magee, Jr. Known austenitic stainless steels such as UNS S31700 and S21000 also provide good pitting resistance, but do not have the desired combination of galling and pitting resistance necessary for petrochemical applications.

It is therefore an object of the present invention to provide a stainless steel alloy which provides a superior combination of galling resistance and chloride corrosion resistance compared to known stainless steels such as Type 316, Gall-Tough ®, or Nittonic 60 ®.

Some commercial applications require a galling resistant stainless steel which can be successfully formed by an upset process, such as cold or warm heading, and which remains substantially non-magnetic after such processing. For example, stainless steel fasteners such as bolts and nuts are usually formed by a cold or warm heading process. When such fasteners are used for certain computer and electronic applications, the fasteners must have good galling resistance and must be substantially non-magnetic.

One known, galling resistant, austenitic stainless steel, Gall-Tough ® is known to form deformation-induced martensite when worked by an upset process. The presence of a significant amount of martensite in such an alloy greatly increases the alloy's magnetic permeability, thereby rendering these alloys unsuitable for certain computer and electronic applications. Further, the presence of a significant amount of deformation-induced martensite in a galling resistant, austenitic, stainless steel alloy greatly increases the alloy's hardness, indicating a high work hardening rate, thereby reducing its utility in products formed by cold or warm heading.

One known stainless steel, UNS S30430, is designed specifically to resist the formation of deformation-induced martensite during the heading process but has less than desirable galling resistance. It would be highly desirable to have an austenitic, galling resistant, stainless steel with superior resistance to the formation of deformation-induced martensite, compared to known austenitic, galling resistant stainless steels.

SUMMARY OF THE INVENTION

In accordance with this invention, an austenitic stainless steel alloy is provided that has superior galling resistance compared to Type 316 stainless steel in combination with mechanical properties and chloride corrosion resistance properties that are at least as good as Type 316. The present alloy is balanced to provide good resistance to the formation of deformation-induced martensite, and thus provides a low work hardening rate and a low magnetic permeability after significant deformation. The austenitic stainless steel alloy according to the present invention consists essentially of, in weight percent, about:

| | Broad | Intermediate | Preferred |
|---|---|---|---|
| C | 0.25 max. | 0.02–0.15 | 0.05–0.12 |
| Mn | 3–10 | 4–8 | 5–7 |
| Si | 2.25–5 | 2.5–4.5 | 3–4 |
| Cr | 15–23 | 16.5–21 | 17.5–19 |
| Ni | 2–12 | 4–10 | 6–9 |
| Mo | 0.5–4.0 | 0.5–2.5 | 0.75–1.5 |
| N | 0.35 max. | 0.05–0.25 | 0.10–0.20 |

and the balance of the alloy is essentially iron except for minor amounts of additional elements which do not detract from the desired properties and the usual impurities found in commercial grades of such steels which may vary in amount from a few hundredths of a percent up to larger amounts that do not objectionably detract from the desired combination of properties provided by the alloy. For example, up to about 0.1 w/o, preferably no more than about 0.04 w/o, of each of the elements phosphorus and sulfur; up to about 0.5 w/o, preferably not more than about 0.2 w/o, of each of the elements tungsten, vanadium and columbium.

The foregoing tabulation is provided as a convenient summary and is not intended thereby to restrict the lower and upper values of the ranges of the individual elements of the alloy of this invention for use solely in combination with each other or to restrict the broad, intermediate or preferred ranges of the elements for use solely in combination with each other. Thus, one or more of the broad, intermediate and preferred ranges can be used with one or more of the other ranges for the remaining elements. In addition, a broad, intermediate or preferred minimum or maximum for an element can be used with the maximum or minimum for that element from one of the remaining ranges. Throughout this application, unless otherwise indicated, all compositions in percent (%) will be in percent by weight.

In the alloy according to the present invention, the elements are balanced to provide an improved combination of galling resistance and corrosion resistance, and to provide a substantially austenitic microstructure in the annealed condition.

In accordance with another aspect of the present invention, the elements are balanced to provide increased resistance to deformation-induced martensite compared to Gall-Tough ®, whereby the alloy according to this invention has low magnetic permeability after the alloy is significantly reduced in cross-sectional area. Further the present alloy has a lower work hardening rate than Gall-Tough ® and AISI Type 304 stainless steel which enhances the alloy's cold formability including an upset process such as cold or warm heading.

In accordance with a further aspect of the present invention, there is provided an austenitic, galling resistant and corrosion resistant article made from this alloy which article has been annealed in the temperature range of approximately 1750°–2050° F. (954°–1121° C.).

DETAILED DESCRIPTION OF THE INVENTION

In the alloy according to the present invention, silicon is important because it contributes to the good galling resistance of this alloy. Good galling resistance is defined herein in terms of a threshold galling stress (TGS) of about 5 to 11 ksi (34.5 to 75.8 MPa). Silicon also benefits the stability of the surface oxide layer and acts as a deoxidizing agent during refining of the alloy. It is believed that silicon contributes to the corrosion resistance of this alloy by interacting with molybdenum and nitrogen to provide unexpectedly superior resistance to pitting and crevice corrosion compared to AISI Type 316 alloy. Therefore, at least about 2.25% and better yet at least about 2.5% silicon is present in this alloy. Silicon promotes the formation of ferrite and sigma phase, and reduces nitrogen solubility in this alloy. Silicon also affects the amount of chromium and molybdenum which can be added while still retaining a fully austenitic microstructure in this alloy. Silicon is, therefore, limited to not more than about 5%, better yet to not more than about 4.5%. For best results this alloy contains about 3–4% silicon.

Nitrogen benefits austenite formation, nitrogen being up to 30 times as effective as nickel for austenite formation, and stabilizes austenite against transformation to martensite. Nitrogen contributes to the good tensile strength and yield strength of this alloy. Nitrogen also benefits the pitting resistance and the galling resistance of this alloy. Therefore, nitrogen can be present up to its limit of solubility in this alloy, which may be about 0.35% max. including as little as about 0.05 nitrogen, but for ease of manufacture, the alloy preferably contains up to about 0.25% nitrogen. For best results this alloy contains about 0.10–0.20% nitrogen.

Carbon benefits austenite formation and stabilizes austenite against transformation to martensite. Therefore, about 0.25% max. carbon can be present in this alloy, including as little as about 0.02%. Carbon contributes to the good tensile strength and yield strength of this alloy. Carbon also benefits the pitting and galling resistance of this alloy. Too much carbon results in sensitization of the alloy, which adversely affects the alloy's resistance to intergranular corrosion, and adversely affects the weldability of this alloy. For these reasons it is preferred that not more than about 0.15% carbon is present in this alloy. For best results this alloy contains about 0.05–0.12% carbon.

To attain the good galling resistance and pitting resistance properties of the present alloy, a minimum combined amount of carbon and nitrogen should be present when the amount of silicon present in the alloy is below about 3.0%. Preferably, at least about 0.25% carbon and nitrogen combined is present in this alloy when less than about 3.0% silicon is present in the alloy.

Nickel contributes to the formation of austenite and stabilizes it against transformation to martensite. Nickel also benefits the general corrosion resistance of this alloy, particularly in acids such as hydrochloric acid or sulfuric acid. Furthermore, nickel reduces the work hardening rate and contributes to the ductility of this alloy. Therefore, at least about 2%, better yet at least about 4% nickel is present in this alloy. Too much nickel adversely affects the galling resistance of this alloy and reduces nitrogen solubility in this alloy. Accordingly, not more than about 12%, better yet not more than about 10% nickel is present in this alloy. For best results about 6–9% nickel is present in this alloy.

At least about 3%, better yet at least about 4%, and preferably at least about 5% manganese is present in this alloy because it increases nitrogen solubility which is important for the formation of the desired austenitic microstructure. Manganese also contributes to the formation of austenite in the alloy and stabilizes the austenite against transformation to martensite. High levels of manganese, like high levels of nickel, adversely affect the galling resistance of this alloy and promote the formation of sigma phase which is undesirable. For this reason, manganese is restricted to not more than about 10%, better yet to not more than about 8%, and for best results to not more than about 7% in this alloy.

Chromium contributes to the good corrosion resistance, in particular, the pitting resistance and crevice corrosion resistance of this alloy. Chromium also increases nitrogen solubility in this alloy. For these reasons at least about 15%, better yet at least about 16.5%, chromium is present. Chromium is a strong ferrite former and in excessive amounts promotes the formation of sigma phase which is undesirable. Accordingly, chromium is restricted to not more than about 23%, better yet to not more than about 21%. For best results about 17.5–19% chromium is present in this alloy.

Molybdenum, like chromium, contributes to the good corrosion resistance of this alloy. More particularly, molybdenum benefits the general pitting resistance and crevice corrosion resistance of this alloy. Molybdenum also increases nitrogen solubility and stabilizes austenite against transformation to martensite. It is believed that molybdenum contributes to the corrosion resistance of this alloy by interacting with nitrogen and silicon to provide unexpectedly superior resistance to pitting and crevice corrosion compared to AISI Type 316 alloy. Therefore, at least about 0.5%, better yet at least about 0.75% molybdenum is present in this alloy. Molybdenum is a strong ferrite former and an excessive amount promotes the formation of sigma phase in this alloy. Accordingly, molybdenum is restricted to not more than about 4.0%, better yet to not more than about 2.5%. For best results, 0.75–1.5% molybdenum is present in this alloy. This alloy preferably contains about 1% molybdenum.

The balance of the alloy is essentially iron except for the usual impurities found in commercial grades of alloys intended for similar service or use. The levels of such elements are controlled so as not to adversely affect the desired properties. For example, up to about 0.025% aluminum, up to about 0.001% magnesium, and up to about 0.02% titanium or misch metal can be retained from deoxidizing additions. Up to about 0.025% calcium can be retained from deoxidizing additions or added to improve machinability.

Optional elements that contribute to desirable properties can be present in amounts that do not detract from the desired combination of properties. In this regard, a small but effective amount of boron, about 0.0005–0.01% can be present in this alloy for its beneficial effect on hot workability. About 3.0% max., preferably about 1.5% max., and better yet about 0.75% max. copper can be present in this alloy for its beneficial effect on the general corrosion resistance of the alloy, particularly corrosion resistance in acid environments. Copper promotes and stabilizes austenite and promotes a low work hardening rate in this alloy. About 5.0% max., better yet about 3.0 max., cobalt can also be present for its beneficial effect on galling resistance and corrosion resistance. Due to its cost cobalt is preferably restricted to not more than a residual amount, e.g. about 1.0% max. About 0.1–0.3% sulfur and/or 0.25–0.5% selenium can be added for improved machinability.

Within the elemental weight percent limits, the elements, C, Mn, Si, Ni, Cr, Mo, and N are balanced to limit the formation of ferrite in this alloy. It is preferred that the total volumetric percentage of ferrite in the microstructure of the alloy as-cast not exceed 10 v/o, better yet not exceed 5 v/o, and that the microstructure of the alloy contain substantially no ferrite in wrought form.

In the stainless steel according to the present invention, the elements are balanced to provide a highly stable austenitic microstructure which provides good resistance to formation of deformation-induced martensite. Although replacing iron with any of the above-listed, austenite-forming elements contributes to the alloy's austenite stability, the contribution of each element towards austenite stability can be greater or lesser relative to the other austenite-forming elements.

No special techniques are required in melting, casting, or working the alloy of the present invention. Arc melting with argon-oxygen decarburization is preferred, but other practices can be used. The initial ingot can be cast as an electrode and remelted to enhance the homogeneity of the alloy. This alloy can also be made by powder metallurgy techniques if desired.

This alloy can be hot worked from a furnace temperature of about 1800°–2400° F. (982°–1316° C.), preferably from about 2100°–2250° F. (1149°–1232° C.), and for best results from about 2200° F. (1204° C.), with reheating as necessary. Annealing can be carried out at about 1750°–2050° F. (954°–1121° C.), preferably at about 1900°–2000° F. (1038°–1093° C.), and for best results at about 1950° F. (1066° C.) for a time depending upon the dimensions of the article. The article is quenched from the annealing temperature, preferably in water.

The alloy of the present invention can be formed into a variety of shapes for a wide variety of uses and it lends itself to the formation of billets, bars, rod, wire, strip, plate, or sheet using conventional practices. The preferred practice is to hot work the ingot to billet form followed by hot rolling the billet to bar, wire, or strip. This alloy can also be formed by an upset process such as cold or warm heading into fasteners, such as bolts, nuts and the like.

EXAMPLES

Set forth in Table I are the weight percent compositions of Examples 1–6 of the alloy according to this invention and comparative heats A-C.

TABLE I

| Ex./Ht. No. | C | Mn | Si | Cr | Ni | Mo | N | Fe |
|---|---|---|---|---|---|---|---|---|
| 1 | .102 | 5.45 | 3.40 | 18.08 | 7.06 | 1.00 | .163 | Bal. |
| 2 | .102 | 5.45 | 3.41 | 18.09 | 7.96 | 1.00 | .167 | Bal. |
| 3 | .104 | 5.46 | 3.49 | 17.60 | 7.54 | 0.51 | .170 | Bal. |
| 4 | .104 | 5.46 | 3.42 | 18.07 | 7.57 | 0.51 | .164 | Bal. |
| 5 | .104 | 5.49 | 3.40 | 17.64 | 7.55 | 1.00 | .175 | Bal. |
| 6 | .104 | 5.47 | 3.42 | 17.62 | 7.99 | 0.99 | .168 | Bal. |
| A | .110 | 5.49 | 3.35 | 16.15 | 5.15 | <.01 | .115 | Bal. |
| B | .102 | 5.50 | 3.42 | 19.09 | 7.05 | 0.01 | .160 | Bal. |
| C | .051 | 2.56 | 2.47 | 17.08 | 7.04 | 0.98 | .140 | Bal. |

The composition of heat A is representative of the current version of the alloy sold under the trademark Gall-Tough ®. The composition of heats B and C are heats outside the composition of the present invention. Examples 1–6 and heats A-C were induction melted under argon and cast as 2¾ in (7 cm) sq ingots. The ingots were forged from 2200° F. (1204° C.) to 1⅛ in (2.9 cm) sq bars. A portion of each forged bar was turned to 1 in (2.54 cm) round bar. To determinte the v/o ferrite in the microstructure in the as-cast condition, a ½ in (1.27 cm) sample was cut from the bottom of each ingot. To determine the v/o ferrite in the microstructure in annealed condition, longitudinal metallographic specimens were cut from the 1 in (2.54 cm) round bar of each example. The specimens were annealed at 1950° F. (1066° C.) for one hour and water quenched. The v/o ferrite in the test samples in the as-cast condition (%α As-Cast) and in the annealed condition (%α Annealed) was measured using a Magne Gage.

To determine the galling resistance of the various heats and Examples in Table I, specimens of Examples 1–6 and heats A-C were prepared and tested as follows. Galling test buttons and blocks were machined from the round bars of each example. The test buttons and blocks of Examples 1–6 and heats A-C were annealed at 1950° F. (1066° C.) for one hour and quenched in water. Parallel, flat, test surfaces, 0.875 in (2.2 cm) wide, were machine ground on opposite sides of each block. One of the test surfaces of each block was ground to have a roughness of 15–40 (Ra) microinches (0.38–1.02 micrometers), (Ra being the roughness parameter).

Each button was machined to form two tiers with parallel flats forming the opposite end surfaces of the button. One tier, forming the test surface of each button, had a reduced diameter of about 0.5 in (1.3 cm)±0.002 in (±0.0051 cm) and a machine ground surface with a roughness of 15–40 (Ra) microinches (0.38–1.02 micrometers). A flat was milled on a side of each button for turning the button with a wrench and a centering hole provided in the end of each button opposite its machine-ground test surface. The test surfaces of each button and block pair were deburred, then their roughness was measured using a profilometer and recorded.

The buttons and blocks were cleaned to remove machining oils and metal particles and then the threshold galling stress, TGS, for each Example and heat was determined in a Tinius-Olsen Tensile machine as follows. A block made from one of the example compositions was fixed in a jig below the mandrel of the tensile testing machine. A button of the same composition was then placed on the block with its test surface against the test surface of the block. The mandrel was then lowered so that the tip of the mandrel was tightly secured in the centering hole of the button. A compressive load was applied to the button/block combination, resulting in a predetermined compressive stress therein. The button was then rotated smoothly with a wrench as follows: counterclockwise 360°, clockwise 360°, and then counterclockwise 360°. The compressive load was then removed, and the test surfaces visually examined for galling. If no galling was observed a new button of the same composition was tested at a higher compressive stress level. Threshold galling stress values were determined to within ±1 ksi (±6.89 MPa). The highest stress in ksi at which galling did not occur is defined herein as the TGS.

Set forth in Table II is the threshold galling stress (TGS), in ksi, for each of Examples 1–6 and heats A-C determined by the aforementioned procedure.

TABLE II

| Ex./Ht. No. | % α As-Cast | % α Annealed | TGS ksi (MPa) |
|---|---|---|---|
| 1 | 6.3 | 0.5 | 11 (75.8) |
| 2 | 4.2 | 0 | 11 (75.8) |
| 3 | 4.5 | 0 | 7 (48.2) |
| 4 | 2.7 | 0 | 11 (75.8) |
| 5 | 3.5 | 0 | 10 (68.9) |
| 6 | 2.3 | 0 | 5 (34.5) |
| A | 7.0 | 0.3 | 14 (96.5) |
| B | 8.0 | 1.8 | 13 (89.6) |
| C | 7.7 | 0.3 | 7 (48.2) |

The data in Table II demonstrates that Examples 1–6 were substantially austenitic in the annealed, wrought condition and had less than about 10% ferrite in the as-cast condition. The data in Table II also demonstrates that the present alloy has much better galling resistance than AISI Type 316 stainless steel which is generally known to have a TGS less than 1 ksi (6.89 MPa). The data also demonstrates that the present alloy has galling resistance which, although somewhat lower than the Gall-Tough® alloy, heat A, is similar to the Nitronic 60® alloy which has a nominal TGS of about 7 ksi (48.2 MPa).

To demonstrate the pitting resistance and crevice corrosion resistance of the alloy according to the present invention, test specimens were prepared and tested as follows. Another portion of the 1⅛ in (2.9 cm) sq bar of Examples 1–6 and heats A-C was milled to approximately 1 in (2.54 cm) sq bar, and then hot rolled to approximately 0.250 in (0.64 cm) thick strip from 2200° F. (1204° C.). The hot rolled strip was then annealed at 1950° F. (1066° C.) for 0.50 hours, water quenched, cold rolled to approximately 0.140 in (0.36 cm) thick, and annealed at 1950° F. (1066° C.) for 15 minutes and water quenched. Test specimens were then cut from the cold-rolled, annealed strip. The specimens for testing general pitting and crevice corrosion resistance were approximately 1 in×2 in (2.54 cm×5.08 cm). The specimens for determining critical pitting temperature were approximately 1 in×1 in (2.54 cm×2.54 cm).

Duplicate test specimens were tested for resistance to crevice corrosion in 6% $FeCl_3$ at 0° C. for 72 hours in accordance with ASTM G-48. Critical pitting temperature tests were performed on triplicate test specimens in a 6% $FeCl_3$ and 1% HCl solution at 0° C. for 72 hours. If pitting did not occur, the test temperature was increased 5 C. until pitting occurred. The samples were reground by hand after each 5 C. incremental increase in temperature. Duplicate test specimens for Examples 1–6 and heats A-C were tested for general pitting resistance in 6% $FeCl_3$ at room temperature for 72 hours in accordance with ASTM G-48.

Shown in Table III are the results of the corrosion testing for Examples 1–6 and heats A-C including the weight loss due to general pitting at room temperature (Pitting-RT), the critical pitting temperature (CPT), and the weight loss due to crevice corrosion at 0° C. (Crevice-0° C.).

TABLE III

| Ex./Ht. No. | Pitting-RT ($mg/cm^2$) | CPT (°C.) | Crevice-0° C. ($mg/cm^2$) |
|---|---|---|---|
| 1 | 0.1, 0.1 | 30, 35, 35 | 0.0, 0.0 |
| 2 | 0.1, 0.1 | 30, 30, 30 | 0.0, 0.0 |
| 3 | 19.9, 19.2 | 25, 25, 25 | 0.0, 0.0 |
| 4 | 17.1, 18.6 | 10, 25, 25 | 0.0, 0.0 |
| 5 | 0.0, 0.0 | 20, 25, 30 | 0.0, 0.0 |
| 6 | 0.1, 15.7 | 25, 25, 30 | 0.0, 0.0 |
| A | 27.6, 25.4 | 0, 10, 10 | 17.3, 17.5 |
| B | 16.2, 21.2 | 30, 20, 20 | 16.5, 16.3 |
| C | 15.5, 15.6 | 0, 0, 10 | 4.5, 0.1 |

The data in Table III demonstrates that Examples 1–6, which sustained no measurable attack, have superior crevice corrosion resistance compared to the Gall-Tough® alloy, heat A, heats B and C, and AISI Type 316 stainless steel which is generally known to undergo moderate to heavy attack in the same crevice corrosion test. The data in Table III also demonstrates that each of Examples 1–6 had a higher critical pitting temperature compared to the Gall-Tough® alloy, heat A, heat C, and the generally expected critical pitting temperature of AISI Type 316 alloy. Further, the results of the general pitting resistance test demonstrate that, effectively, Examples 1, 2, and 5, and one of the test specimens from Example 6 had either no or very little weight loss in this test. It is also significant to note that Examples 3 and 4, having the lowest molybdenum content of the examples tested, had pitting weight loss at least as good as the Gall-Tough® alloy, heat A, and Type 316 stainless steel.

To demonstrate the present alloy's good resistance to deformation-induced martensite, a cold rolling study was performed on test specimens prepared from Examples 1–6 and heat A which were prepared and tested as follows. A further portion of the 1⅛ in (2.9 cm) sq bar of each of Examples 1–6 and heat A was milled to approximately 1 in (2.54 cm) sq bar and hot rolled to approximately 0.250 in (0.64 cm) thick strip from 2200° F. (1204° C.). The strip was then annealed at 1950° F. (1066° C.) for 0.5 hours, water quenched, cold rolled to approximately 0.140 in (0.36 cm) thick, and annealed at 1950° F. (1066° C.) for 0.5 hours and water quenched. Test specimens approximately 2 in×5 in (5.08 cm×12.7 cm) were then cut and machined from the cold-rolled annealed strip. The test specimens were repeatedly cold-rolled to provide a reduction in thickness of about 5% during each pass. After each cold-rolling pass the hardness and magnetic permeability of the specimens were measured. Hardness was measured using the Rockwell hardness instrument on either the B or C hardness scale while magnetic permeability was measured using a Severn Gage.

Shown in Table IV is the hardness (HRC/HRB) and shown in Table V is the magnetic permeability ($\mu<$) of each of Examples 1–6 and heat A determined by the aforementioned procedure. The hardness values represent the average of three readings from each specimen. The magnetic permeability values represent the lowest standard setting on the Severn Gage at which the specimen was magnetically attracted to the gage. Thus, the magnetic permeability of each Example is actually less than the standard value recorded in Table V. For instance, Example 1 having a recorded magnetic permeability value of 1.10 after a 5% cold reduction, has an actual magnetic permeability which is less than 1.10 but greater than the next lowest standard setting on the Severn Gage which, in this instance, equals 1.05. In other words, $1.05<\mu<1.10$.

TABLE IV

| % Cold Reduction | Hardness-HRC(HRB) | | | | | | |
|---|---|---|---|---|---|---|---|
| | Ex. 1 | Ex. 2 | Ex. 3 | Ex. 4 | Ex. 5 | Ex. 6 | Ht. A |
| 0 | (97) | (93.5) | (91.0) | (92.5) | (90.5) | (90) | 24.5 |
| 5 | 26 | 25 | 22 | 23.5 | 24 | 23 | 29 |
| 10 | 30 | 27 | 27 | 27 | 28 | 26 | 34 |
| 15 | 33 | 30.5 | 31 | 31 | 31 | 30.5 | 38 |
| 20 | 35 | 33 | 33.5 | 32.5 | 33 | 33.5 | 40 |
| 25 | 37.5 | 36 | 37 | 37 | 37 | 37 | 42 |
| 30 | 39 | 38 | 38 | 38.5 | 38 | 38 | 44.5 |

TABLE IV-continued

| % Cold Reduction | Hardness-HRC(HRB) | | | | | | |
|---|---|---|---|---|---|---|---|
| | Ex. 1 | Ex. 2 | Ex. 3 | Ex. 4 | Ex. 5 | Ex. 6 | Ht. A |
| 35 | 41 | 39 | 40 | 40 | 40 | 40 | 46 |
| 40 | 42 | 41 | 41 | 41 | 41 | 40.5 | 46.5 |
| 45 | 43 | 41.5 | 42 | 42 | 42 | 41 | 47 |
| 50 | 43.5 | 42 | 43 | 43 | 42.5 | 42 | 47 |

TABLE V

| % Cold Reduction | Magnetic Permeability ($\mu<$) | | | | | | |
|---|---|---|---|---|---|---|---|
| | Ex. 1 | Ex. 2 | Ex. 3 | Ex. 4 | Ex. 5 | Ex. 6 | Ht. A |
| 0 | 1.05 | 1.02 | 1.02 | 1.02 | 1.02 | 1.02 | 1.05 |
| 5 | 1.10 | 1.02 | 1.02 | 1.02 | 1.02 | 1.02 | 1.20 |
| 10 | 1.10 | 1.02 | 1.02 | 1.02 | 1.02 | 1.02 | 3.00 |
| 15 | 1.10 | 1.02 | 1.02 | 1.02 | 1.02 | 1.02 | 6.00 |
| 20 | 1.10 | 1.02 | 1.05 | 1.05 | 1.02 | 1.02 | 8.00 |
| 25 | 1.10 | 1.02 | 1.05 | 1.05 | 1.05 | 1.05 | >8.00 |
| 30 | 1.20 | 1.05 | 1.10 | 1.20 | 1.10 | 1.05 | >8.00 |
| 35 | 1.40 | 1.05 | 1.20 | 1.20 | 1.20 | 1.05 | >8.00 |
| 40 | 1.60 | 1.05 | 1.40 | 1.40 | 1.20 | 1.10 | >8.00 |
| 45 | 1.80 | 1.10 | 1.40 | 1.60 | 1.20 | 1.10 | >8.00 |
| 50 | 3.00 | 1.20 | 1.60 | 1.80 | 1.40 | 1.20 | >8.00 |

The data in Tables IV and V demonstrate that the present alloy has much greater resistance to deformation-induced martensite than Gall-Tough®, heat A, and Type 304 stainless steel as indicated by the alloy's low hardness and low magnetic permeability in the cold worked condition, up to about 25% reduction in cross-sectional area. Type 304 stainless steel has hardness and magnetic permeability values greater than the values reported in Tables IV and V.

In summary, the alloy of the present invention has a better combination of properties, including galling resistance, corrosion resistance, and resistance to formation of deformation-induced martensite, than either of the known galling resistant, austenitic, stainless steels.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An austenitic stainless steel alloy having a unique combination of galling resistance, corrosion resistance, and resistance to formation of deformation-induced martensite, said alloy consisting essentially of, in weight percent, about

| | % |
|---|---|
| Carbon | 0.25 max. |
| Manganese | 4–10 |
| Silicon | 2.25–5 |
| Chromium | 16.5–23 |
| Nickel | 6–12 |
| Molybdenum | 0.5–4 |
| Nitrogen | 0.35 max. |
| Copper | 3.0 max. |
| Cobalt | 5.0 max. |
| Boron | 0.01 max. |
| Sulfur | 0.3 max. |

and the balance is essentially iron, wherein (%C+%N) is at least about 0.25% when the amount of silicon present in the alloy is less than about 3%.

2. The alloy as set forth in claim 1 containing no more than about 10% ferrite in the as-cast condition and being substantially austenitic in the annealed, wrought condition.

3. The alloy as set forth in claim 1 having at least about 0.75% molybdenum.

4. The alloy as set forth in claim 1 having at least about 1% molybdenum.

5. The alloy as set forth in claim 1 having not more than about 2.5% molybdenum.

6. The alloy as set forth in claim 1 having at least about 0.05% nitrogen.

7. An austenitic stainless steel alloy having a good combination of galling resistance, corrosion resistance, and resistance to formation of deformation-induced martensite, said alloy consisting essentially, in weight percent, of about

| | % |
|---|---|
| Carbon | 0.02–0.15 |
| Manganese | 4–8 |
| Silicon | 2.5–4.5 |
| Chromium | 16.5–21 |
| Nickel | 6–10 |
| Molybdenum | 0.5–2.5 |
| Nitrogen | 0.05–0.25 |
| Copper | 1.5 max. |
| Cobalt | 3.0 max. |

and the balance is essentially iron, wherein (%C+%N) is at least about 0.25% when the amount of silicon present in the alloy is less than about 3%.

8. The alloy as set forth in claim 7 containing no more than about 5% ferrite in the as-cast condition and being substantially austenitic in the annealed, wrought condition.

9. The alloy as set forth in claim 7 having at least about 0.75% molybdenum.

10. The alloy as set forth in claim 7 having at least about 1.0% molybdenum.

11. The alloy as set forth in claim 7 having at least about 0.10% nitrogen.

12. An austenitic stainless steel alloy as set forth in claim 7 consisting essentially, in weight percent, of about

| | % |
|---|---|
| Carbon | 0.05–0.12 |
| Manganese | 5–7 |
| Silicon | 3–4 |
| Chromium | 17.5–19 |
| Nickel | 6–9 |
| Molybdenum | 0.75–1.5 |
| Nitrogen | 0.10–0.20 |

and the balance is essentially iron.

13. The alloy as set forth in claim 12 containing no more than about 5% ferrite in the as-cast condition and being substantially austenitic in the annealed, wrought condition.

14. The alloy as set forth in claim 12 having at least about 1.0% molybdenum.

15. A galling resistant article formed of an austenitic, stainless steel alloy consisting essentially, in weight percent, of about

| | % |
|---|---|
| Carbon | 0.25 max. |
| Manganese | 4–10 |
| Silicon | 2.25–5 |
| Chromium | 16.5–23 |
| Nickel | 6–12 |
| Molybdenum | 0.5–4.0 |
| Nitrogen | 0.35 max. |
| Copper | 3.0 max. |
| Cobalt | 5.0 max. |
| Boron | 0.01 max. |
| Sulfur | 0.3 max. |

and the balance is essentially iron, said article having been annealed at a temperature and for a time sufficient to provide a substantially austenitic microstructure in said alloy.

16. An article formed from an austenitic, stainless steel alloy as set forth in claim 15 which has been annealed at a temperature of about 1750° (954° C.) to 2050° F. (1121° C.).

17. An article formed from an austenitic, stainless steel alloy as set forth in claim 15 which has been annealed at a temperature of about 1900° (1038° C.) to 2000° F. (1093° C.).

18. An article formed from an austenitic, stainless steel alloy as set forth in claim 15 which has been annealed at about 1950° F. (1066° C.).

19. An article formed from an austenitic, stainless steel alloy as set forth in claim 15 having a threshold galling stress of at least 5 ksi (34.5 MPa) in the threshold galling stress test described in the foregoing specification.

20. An article formed from an austenitic, stainless steel alloy as set forth in claim 15 having a magnetic permeability, as measured using a Severn Gage, less than about 3 when cold-rolled to a 50% reduction in cross-sectional area.

21. An article formed from an austenitic, stainless steel alloy as set forth in claim 15 having a magnetic permeability, as measured using a Severn Gage, less than about 1.1 when cold-rolled to a 25% reduction in cross-sectional area.

22. An article formed from an austenitic stainless steel as recited in claim 15 having a hardness, as measured using a Rockwell C Hardness scale, less than about 38 when cold-rolled to a 25% reduction in cross-sectional area.

23. An article formed from an austenitic stainless steel as recited in claim 15 having a critical pitting temperature not less than 10° C. in the critical pitting test described in the foregoing specification.

24. An article formed from an austenitic stainless steel as recited in claim 15 having substantially no crevice weight loss at 0° C. in the crevice test described in the foregoing specification.

25. An article formed of an austenitic, stainless-steel alloy as set forth in claim 15 containing

| | % |
|---|---|
| Carbon | 0.02–0.15 |
| Manganese | 4–8 |
| Silicon | 2.5–4.5 |
| Chromium | 16.5–21 |
| Nickel | 4–10 |
| Molybdenum | 0.5–2.5 |

-continued

| | % |
|---|---|
| Nitrogen | 0.05–0.25 |

26. An article formed of an austenitic, stainless steel alloy as set forth in claim 15 containing

| | % |
|---|---|
| Carbon | 0.05–0.12 |
| Manganese | 5–7 |
| Silicon | 3–4 |
| Chromium | 17.5–19 |
| Nickel | 6–9 |
| Molybdenum | 0.75–1.5 |
| Nitrogen | 0.10–0.20 |

* * * * *